US008749535B2

(12) United States Patent
Kim et al.

(10) Patent No.: US 8,749,535 B2
(45) Date of Patent: Jun. 10, 2014

(54) CLOCK-SHARED DIFFERENTIAL SIGNALING INTERFACE AND RELATED METHOD

(75) Inventors: Nyun Tae Kim, Yongin-si (KR); Ji Woon Jung, Gwangmyeong-si (KR); Sung Ho Kang, Daegu (KR); Sun-Mi Cheong, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 578 days.

(21) Appl. No.: 12/509,615

(22) Filed: Jul. 27, 2009

(65) Prior Publication Data

US 2010/0085084 A1 Apr. 8, 2010

(30) Foreign Application Priority Data

Oct. 7, 2008 (KR) ..... 10-2008-0097941

(51) Int. Cl.
*G09G 5/00* (2006.01)

(52) U.S. Cl.
USPC ..... 345/204; 345/208; 345/212; 345/213; 345/690

(58) Field of Classification Search
USPC ..... 345/76, 87, 98–100, 204
See application file for complete search history.

(56) References Cited

U.S. PATENT DOCUMENTS 6,144,355 A * 11/2000 Murata et al. ..... 345/99
6,407,730 B1 * 6/2002 Hori ..... 345/100
6,940,496 B1 * 9/2005 Kim ..... 345/204
7,193,597 B2 * 3/2007 Sunohara ..... 345/98
7,330,502 B2 * 2/2008 Hotta ..... 375/221
7,746,315 B2 * 6/2010 Li et al. ..... 345/100
7,999,799 B2 * 8/2011 Fukuo ..... 345/204
8,111,233 B2 * 2/2012 Arai ..... 345/99
2001/0013850 A1 * 8/2001 Sakaguchi et al. ..... 345/87
2003/0128198 A1 * 7/2003 Mizuyabu et al. ..... 345/204
2004/0178976 A1 * 9/2004 Jeon et al. ..... 345/87
2007/0046590 A1 * 3/2007 Umezaki et al. ..... 345/76
2008/0007508 A1 * 1/2008 Yoneyama ..... 345/100
2008/0100633 A1 * 5/2008 Dallas et al. ..... 345/530
2008/0111649 A1 * 5/2008 Ryu ..... 333/17.3
2008/0204388 A1 * 8/2008 Lee et al. ..... 345/87
2009/0096736 A1 * 4/2009 Nam et al. ..... 345/94
2010/0225620 A1 * 9/2010 Lee ..... 345/204

FOREIGN PATENT DOCUMENTS

CN 101101742 A 1/2008
JP 05191421 A 7/1993
JP 05250280 A 9/1993

(Continued)

OTHER PUBLICATIONS

Japanese Office Action Issued in Japanese Patent Application No. 2009-229658, Issued October 24, 2013.

(Continued)

*Primary Examiner* — Gregory J Tryder
(74) *Attorney, Agent, or Firm* — Volentine & Whitt, PLLC

(57) ABSTRACT

The present invention provides a clock-shared differential signaling interface and a method of driving output data to a display panel. The apparatus includes a plurality of driver circuits, wherein each driver circuit in the plurality of driver circuits respectively provides output data. The apparatus also includes a timing controller providing a first clock signal to the plurality of driver circuits via a multi-drop connection, and providing a respective differential data signal to each driver circuit via a respective point-to-point connection.

26 Claims, 11 Drawing Sheets

(56) References Cited

FOREIGN PATENT DOCUMENTS

| | | | |
|---|---|---|---|
| JP | 08-106075 | | 4/1996 |
| JP | 09-149018 | | 6/1997 |
| JP | 2001109437 | | 4/2001 |
| JP | 2002517790 | A | 6/2002 |
| JP | 2003157230 | A | 5/2003 |
| JP | 2003168973 | | 6/2003 |
| JP | 2007072440 | | 3/2007 |
| KR | 1020070048264 | A | 5/2007 |

OTHER PUBLICATIONS

Chinese Office Action in Related Chinese Patent Application No. 200910170981.3, Issued Apr. 15, 2013.

* cited by examiner

CLOCK-SHARED DIFFERENTIAL SIGNALING INTERFACE AND RELATED METHOD

CROSS-REFERENCE TO RELATED APPLICATION

This application claims the benefit of Korean Patent Application No. 10-2008-0097941 filed on Oct. 7, 2008, the subject matter of which is hereby incorporated by reference.

BACKGROUND

The invention relates generally to circuits and control methods associated with display apparatuses. More particularly, the invention relates to circuitry and related methods associated with timing controllers and interfaces between timing controllers and display apparatuses.

Display apparatuses such as computer and laptop displays, video displays, television sets, and the like, have greatly increased in overall physical size. At the same time, high-definition (HD) functionality has been incorporated into these much larger display apparatuses. Many display apparatuses now operate at frame rates exceeding 120 Hz and enable the display of more channels at much higher resolution. All of the foregoing has created a very real demand for increased rates of digital data provision to contemporary display apparatuses.

One critical point along the digital data transmission path to a display apparatus is the interface between the display apparatus and a corresponding timing controller (TCON). It is anticipated that data transmission rates between TCONs and associated display apparatuses will reach 500 to 2000 million bits per second (Mbps) in order to provide the data bandwidth necessary to support the number and quality of video/audio channels being promised consumers. Current data transmission rates between conventional TCONS and associated display apparatuses run in the order of one to two hundred Mbps.

SUMMARY

Embodiments of the invention provide a clock-shared differential signaling interface and a method of driving output data to a display panel.

In accordance with at least one embodiment, the invention provides an apparatus comprising a plurality of driver circuits, wherein each driver circuit in the plurality of driver circuits respectively provides output data. The apparatus also comprises a timing controller providing a first clock signal to the plurality of driver circuits via a multi-drop connection, and providing a respective differential data signal to each driver circuit via a respective point-to-point connection.

In accordance with at least one embodiment, the invention provides a display apparatus comprising a display panel and a plurality of driver circuits respectively providing output data to the display panel. The display panel also comprises a timing controller providing a first clock signal to the plurality of driver circuits via a multi-drop connection, and providing a respective differential data signal to each driver circuit via a respective point-to-point connection.

In accordance with at least one embodiment, the invention provides a method of driving output data to a display panel. The method comprises generating a first clock signal from a second clock signal, providing the first clock signal to each driver circuit of a plurality of driver circuits via a multi-drop connection, and providing differential data signals to the driver circuits, respectively, via respective point-to-point connections. The method also comprises regenerating a third clock signal from the first clock signal at each of the driver circuits, generating a portion of the output data at each of the driver circuits in relation to the third clock signal and the received differential data signal, and providing the output data to the display panel.

BRIEF DESCRIPTION OF THE DRAWINGS

Embodiments of the invention will be described herein with reference to the accompanying drawings in which like reference symbols indicate similar elements throughout. In the drawings.

DESCRIPTION OF EMBODIMENTS

Figure 1:
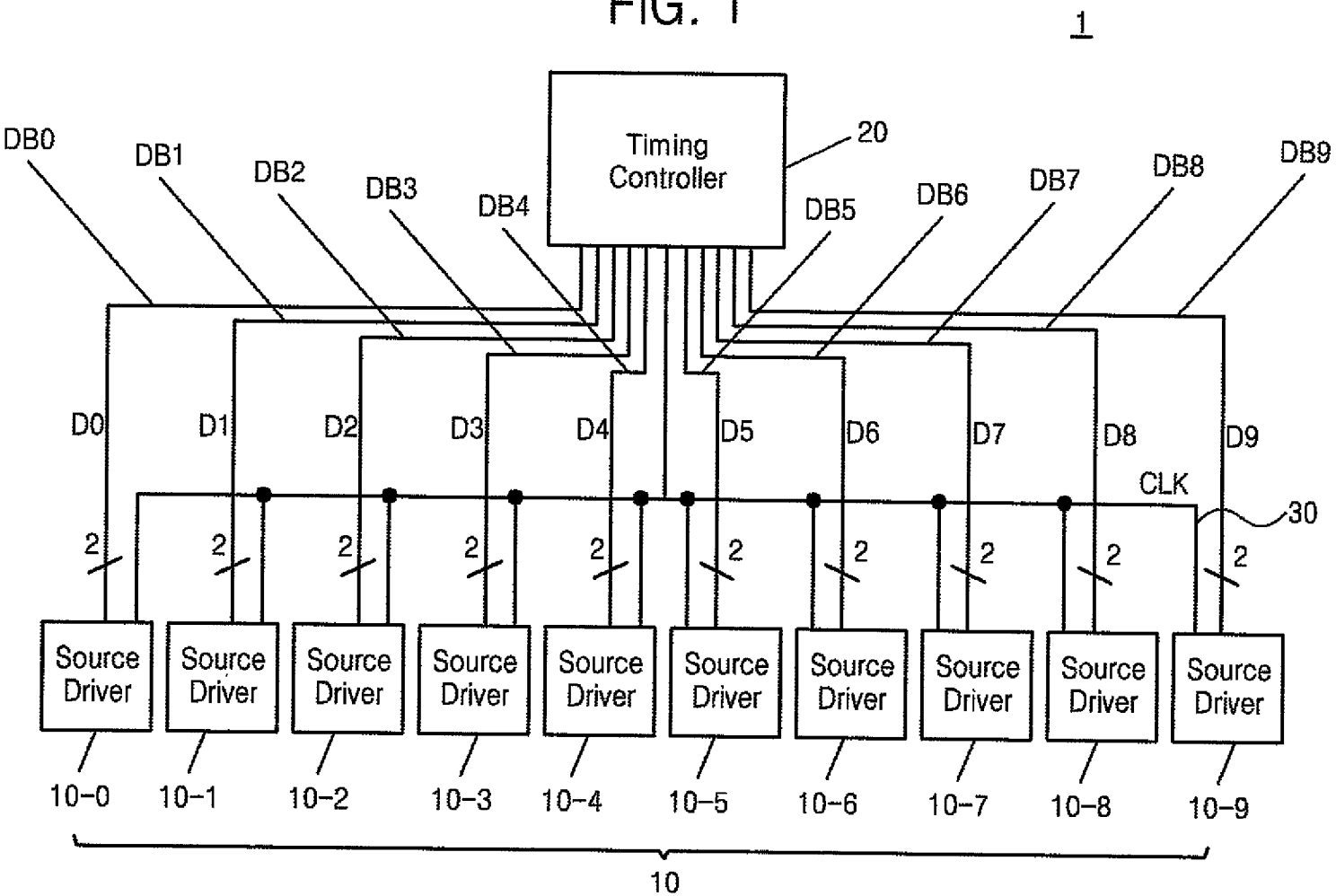
FIG. 1 is a conceptual block diagram illustrating a clock-shared differential signaling interface in a display apparatus in accordance with an embodiment of the invention.

FIG. 1 is a conceptual block diagram illustrating a clock-shared differential signaling interface 1 in a display apparatus in accordance with an embodiment of the invention. In the embodiment illustrated in FIG. 1, clock-shared differential signaling interface 1 comprises a timing controller 20 connected to a source driver unit 10 including a plurality of source drivers 10-0 through 10-9. While source driver unit 10 illustrated in FIG. 1 comprises ten source drivers, it may comprise any reasonable number of source drivers in accordance with other embodiments of the invention.

In addition, clock-shared differential signaling interface 1 comprises data buses DB0 through DB9. Each of data buses DB0 through DB9 is connected between timing controller 20 and a respective source driver in the plurality of source drivers 10-0 through 10-9. Thus, timing controller 20 respectively provides differential data signals D0 through D9 to source drivers 10-0 through 10-9 via data buses DB0 through DB9. With this configuration, data buses DB0 through DB9 form "point-to-point" connections between timing controller 20 and source drivers 10-0 through 10-9. As used herein, a point-to-point connection between a timing controller and an associated driver exclusively connects the timing controller with only the given driver. Hence, any connection (e.g., signal line or bus) through which a timing controller provides signal(s) to more than one driver (e.g., a multi-drop connection) is not considered a "point-to-point" connection, as that term is used herein.

Clock-shared differential signaling interface 1 also comprises a shared differential clock signal bus 30 commonly connecting timing controller 20 with each one of the plurality of source drivers 10-0 through 10-9. Thus, shared differential clock signal bus 30 forms a multi-drop connection between timing controller 20 and the plurality of source drivers 10-0 through 10-9, such that timing controller 20 provides a shared differential clock signal CLK to each of source drivers 10-0 through 10-9 via shared differential clock signal bus 30.

With the foregoing configuration, timing controller 20 within the clock-shared differential signaling interface 1 of FIG. 1 provides differential data signals to the plurality of source drivers 10-0 through 10-9 via point-to-point connections, while also providing a shared differential clock signal CLK to each of source drivers 10-0 through 10-9 via a multi-drop connection. It is assumed for purposes of this description that the clock-shared differential signaling interface 1 uses two-level signaling. As used herein, "two-level signaling" is a signaling system using signals that transition between two meaningful logic levels, and "multi-level signaling" is a signaling system using signals that transition among three or more meaningful logic levels.

In addition, a clock-shared differential signaling interface in accordance with an embodiment of the invention enables the provision of an increased data rate relative to a conventional multi-drop interface without using multi-level signaling or embedded-clock signaling. Thus, a clock-shared differential signaling interface in accordance with an embodiment of the invention may provide an increased data rate while avoiding the disadvantages of multi-level signaling and embedded-clock signaling. As used herein, "embedded-clock signaling" means transferring signals that have an embedded clock signal.

Because clock-shared differential signaling interface 1 in accordance with an embodiment of the invention uses two-level signaling, circuitry in timing controller 20 used to provide signals to source drivers 10-0 through 10-9, and circuitry in source drivers 10-0 through 10-9 processing signals received from timing controller 20 may be less complex than corresponding circuitry in conventional interfaces using embedded-clock signaling and multi-level signaling. Additionally, circuitry in source drivers 10-0 through 10-9 of clock-shared differential signaling interface 1 processing signals received from timing controller 20 may also be less complex than corresponding circuitry in conventional interfaces that use embedded-clock signaling and two-level signaling.

Thus, the size and power consumption of the circuitry used to implement a clock-shared differential signaling interface in accordance with an embodiment of the invention may be less than the size and power consumption of the circuitry used to implement conventional interfaces that use embedded-clock signaling and either two-level signaling or multi-level signaling. For example, a clock-shared differential signaling interface in accordance with an embodiment of the invention may omit encoding and decoding circuitry necessary to implement embedded-clock signaling.

Additionally, a transfer protocol used for providing data from a timing controller to source drivers in a clock-shared differential signaling interface in accordance with an embodiment of the invention may be less complex than corresponding transfer protocols in conventional interfaces that use embedded-clock signaling.

Also, the speed at which signals are provided to source drivers 10-0 through 10-9 of clock-shared differential signaling interface 1 may be less than the speed at which signals are provided to source drivers in conventional interfaces using embedded-clock signaling. For example, the speed with which signals are provided to source drivers 10-0 through 10-9 of clock-shared differential signaling interface 1 may be more than 20% less than the speed at which signals are provided to source drivers in conventional interfaces using embedded-clock signaling. Thus, a clock-shared differential signaling interface in accordance with an embodiment of the invention does not require certain conventionally mandated circuitry necessary to the provision of relatively faster signal transfer speeds such as those commonly used with conventional embedded-clock interfaces. As a result, the size and power consumption of circuitry used to implement a clock-shared differential signaling interface in accordance with an embodiment of the invention may be less than the size and power consumption of conventional circuitry associated with conventional interfaces using embedded-clock signaling.

In addition, a clock-shared differential signaling interface in accordance with an embodiment of the invention may also have reduced impedance mismatch relative to a conventional interface using multi-drop connections, and may therefore provide improved signal integrity.

Figure 2:
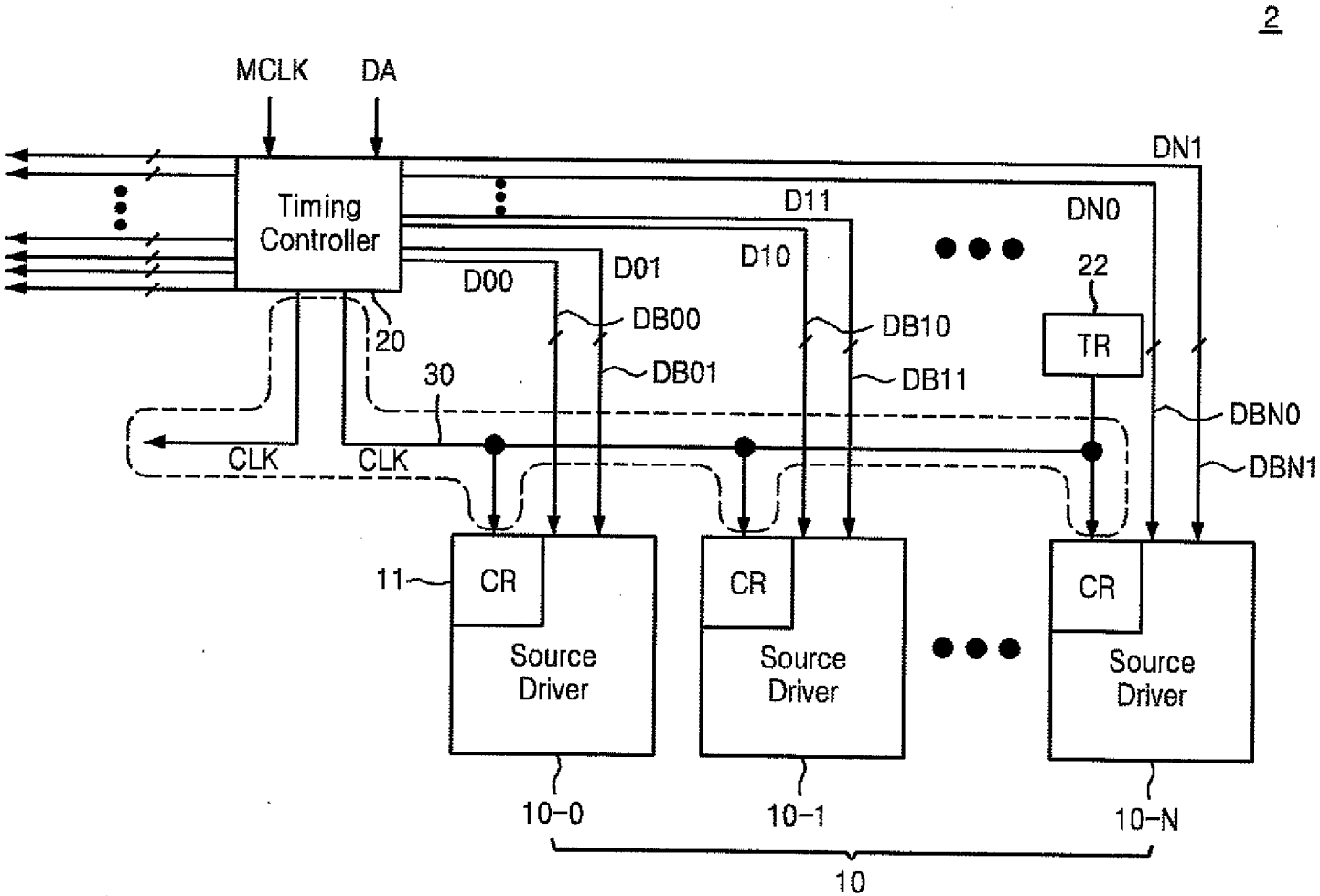
FIG. 2 is a circuit diagram illustrating a clock-shared differential signaling interface in accordance with an embodiment of the invention.

FIG. 2 is a circuit diagram illustrating a clock-shared differential signaling interface 2 in accordance with an embodiment of the invention. Clock-shared differential signaling interface 2 provides an interface between timing controller 20 and a plurality of source drivers 10-0 through 10-N of a source driver unit 10, wherein N is a positive integer greater than 2. Clock-shared differential signaling interface 2 comprises point-to-point connections between timing controller 20 and each of source drivers 10-0 through 10-N, and timing controller 20 provides differential data to each of source drivers 10-0 through 10-N using those point-to-point connections. Clock-shared differential signaling interface 2 further comprises a shared differential clock signal bus 30 providing a multi-drop connection between timing controller 20 and source drivers 10-0 through 10-N. In addition, timing controller 20 provides a shared differential clock signal CLK to each of source drivers 10-0 through 10-N via the multi-drop connection provided by shared differential clock signal bus 30.

In the embodiment illustrated in FIG. 2, timing controller 20 receives a master clock signal MCLK and input data DA from, for example, a host (not shown) or external memory (not shown). Timing controller 20 generates shared differential clock signal CLK from master clock signal MCLK and provides shared differential clock signal CLK to each of source drivers 10-0 through 10-N via the multi-drop connection provided by shared differential clock signal bus 30. The frequency of master clock signal MCLK is greater than the frequency of shared differential clock signal CLK.

Timing controller 20 also generates differential data signals D00, D01 through DN0, DN1 from input data DA, and provides differential data signals D00, D01 through DN0, DN1 to source drivers 10-0 through 10-N, respectively. In addition, timing controller 20 provides the differential data signals to the source drivers via data buses DB00, DB01 through DBN0, DBN1, which form point-to-point connections between timing controller 20 and source drivers 10-0 through 10-N. Thus, in the embodiment illustrated in FIG. 2, timing controller 20 provides differential data signals D00, D01 through DN0, DN1 to source drivers 10-0 through 10-N, respectively, via data buses DB00, DB01 through DBN0, DBN1, respectively. Additionally, each of source drivers 10-0 through 10-N comprises a clock regenerator (CR) circuit 11 comprising a phase-lock-loop (PLL) or delay-lock-loop (DLL) circuit. Clock-shared differential signaling interface 2 may also comprise a terminal resistor (TR) circuit 22 connected to shared differential clock signal bus 30. In the illustrated embodiment of FIG. 2, terminal resistor 22 is shown as a finite bus element associated with a last source driver 10-N. However, terminal resistor 22 may be provided as a distributed element along shared differential clock signal bus 30. However provided, terminal resistor 22 may be used to correct impedance mismatches and reduce or eliminate signal reflections along shared differential clock signal bus 30.

By providing a clock signal having a relatively low frequency to the source drivers, the signal integrity of the clock signal provided to the source drivers via shared differential clock signal bus 30 may be enhanced. Additionally, the adverse effects of electro-magnetic interference (EMI) on the clock signal may be reduced by providing a clock signal having a relatively lower frequency to the source drivers.

Figure 3:
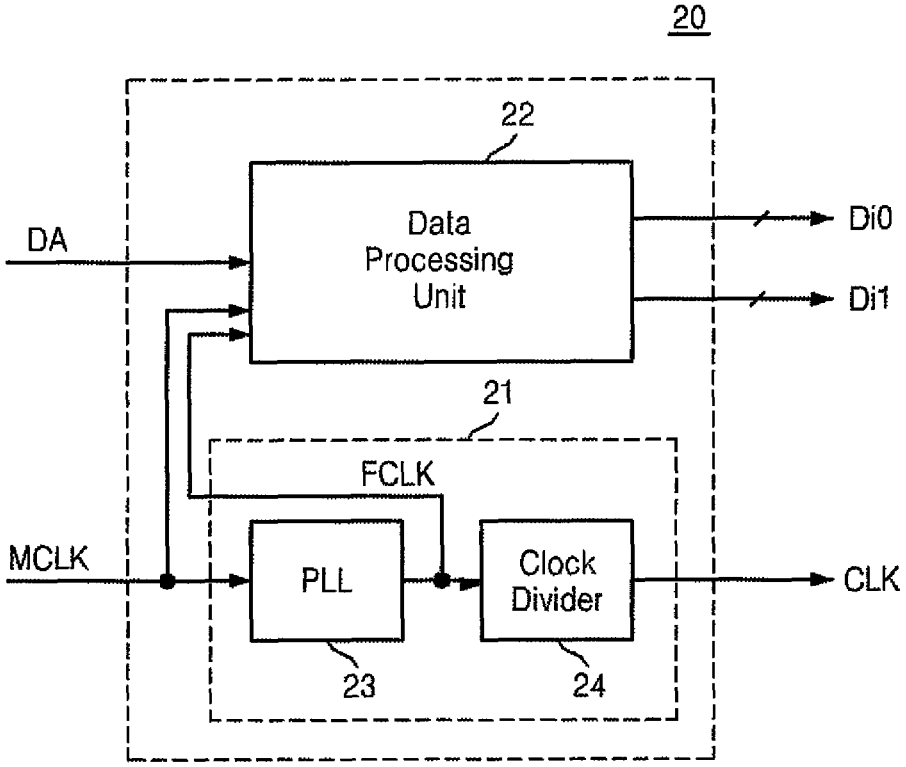
FIG. 3 is a circuit diagram illustrating a timing controller of the clock-shared differential signaling interface of FIG. 2 in some additional detail in accordance with an embodiment of the invention.

FIG. 3 is a circuit diagram illustrating timing controller 20 of clock-shared differential signaling interface 2 of FIG. 2 in some additional detail in accordance with an embodiment of the invention. In the embodiment illustrated in FIG. 3, timing controller 20 comprises a data processing unit 22 and a clock generator 21. In addition, clock generator 21 comprises a PLL circuit 23 and a clock divider 24.

Data processing unit 22 receives input data DA from a host (not shown) or external memory (not shown) and also receives master clock signal MCLK. Additionally, data processing unit 22 receives a synchronous master clock signal FCLK from clock generator 21. After processing input data DA, data processing unit 22 provides two differential data signals Di0 and Di1 to source driver 10-*i* among source drivers 10-0 through 10-N via a point-to-point connection between timing controller 20 and source driver 10-*i*. As used herein, "i" is an integer between 0 and N, inclusive, and each of differential data signals Di0 and Di1 may be a pair of data signals. Referring to FIGS. 2 and 3, data processing unit 22 may provide two differential data signals Di0 and Di1 to each source driver 10-*i* among source drivers 10-0 through 10-N via respective point-to-point connections between timing controller 20 and source drivers 10-0 through 10-N. Additionally, data processing unit 22 may provide more than two differential data signals to each source driver 10-*i* via more than two point-to-point connections between timing controller 20 and source driver 10-*i*. The additional point-to-point connections may be provided by additional data buses.

Clock generator 21 receives master clock signal MCLK and provides shared differential clock signal CLK to each of source drivers 10-0 through 10-N via a multi-drop connection. PLL circuit 23 of clock generator 21 receives master clock signal MCLK, generates synchronous master clock signal FCLK, and provides synchronous master clock signal FCLK to data processing unit 22 and clock divider 24. Clock divider 24 receives synchronous master clock signal FCLK and generates shared differential clock signal CLK, which timing controller 20 provides to each of source drivers 10-0 through 10-N. In the embodiment illustrated in FIG. 3, clock divider 24 receives synchronous master clock signal FCLK, which is derived from master clock signal MCLK, and divides down synchronous master clock signal FCLK to generate shared differential clock signal CLK. The frequency of shared differential clock signal CLK is lower than the frequency of master clock signal MCLK. Clock divider 24 may divide the frequency of master clock signal MCLK by ten (10), for example, to generate shared differential clock signal CLK. Thus, when master clock signal MCLK has a frequency of 1 Ghz, for example, the shared differential clock signal CLK generated by clock divider 24 may have a frequency of 100 Mhz.

Figure 4:
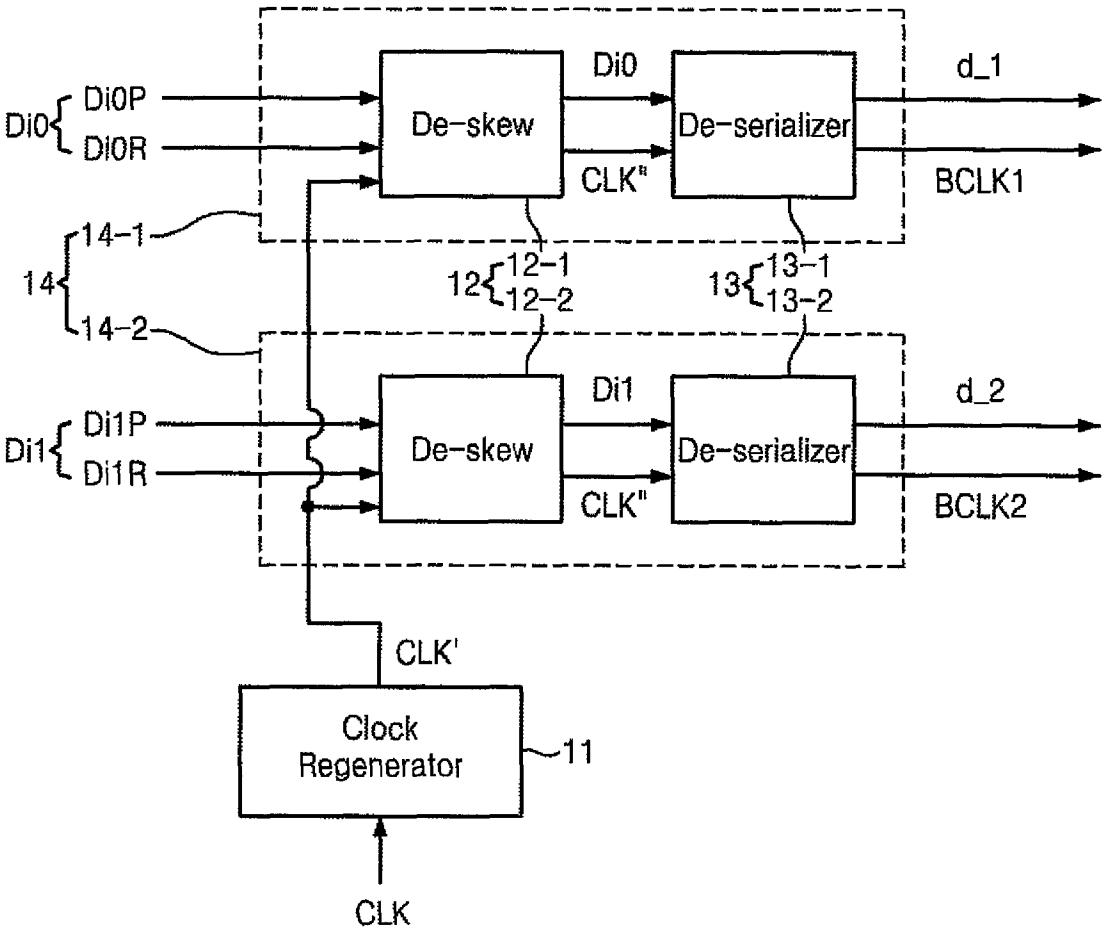
FIG. 4 is a circuit diagram illustrating a source driver of the clock-shared differential signaling interface of FIG. 2 in some additional detail in accordance with an embodiment of the invention.

FIG. 4 is a circuit diagram illustrating a source driver 10-*i* of clock-shared differential signaling interface 2 of FIG. 2 in some additional detail in accordance with an embodiment of the invention. Source driver 10-*i* of FIG. 4 illustrates the configuration of each individual source driver among source drivers 10-0 through 10-N of FIG. 2 in accordance with an embodiment of the invention. In the embodiment illustrated in FIG. 4, source driver 10-*i* comprises a source driver data processing unit 14, a de-skew unit 12, a de-serializer unit 13, and a clock regenerator 11. Source driver data processing unit 14 comprises a first data processing unit 14-1 and a second data processing unit 14-2. First data processing unit 14-1 comprises a first de-skew circuit 12-1 and a first de-serializer circuit 13-1. Second data processing unit 14-2 comprises a second de-skew circuit 12-2 and a second de-serializer circuit 13-2.

Clock regenerator 11 receives shared differential clock signal CLK having a frequency lower than that of master clock signal MCLK, and regenerates an internal clock signal CLK'. The frequency of internal clock signal CLK' is higher than the frequency of shared differential clock signal CLK. In addition, while internal clock signal CLK' has a greater frequency than shared differential clock signal CLK, the frequency of internal clock signal CLK' is not necessarily the same as the frequency of master clock signal MCLK. As used herein, "regenerating" a clock signal means, after generating a second clock signal from a first clock signal (wherein the first clock signal has a higher frequency than the second clock signal), generating a third clock signal from the second clock signal (wherein the third clock signal has a higher frequency than the second clock signal). However, the frequencies of the first and third clock signals are not necessarily equal. Thus, as used herein, "regenerating" does not necessarily mean that the first and third clock signals have the same frequency.

Clock regenerator 11 provides internal clock signal CLK' to first de-skew circuit 12-1 and second de-skew circuit 12-2. Clock regenerator 11 may comprise a PLL circuit or a DLL circuit. Additionally, in the embodiment illustrated in FIG. 4, source driver data processing unit 14 receives first and second differential data signals Di0 and Di1 from timing controller 20 (see FIG. 2). As illustrated in FIG. 4, first differential data signal Di0 comprises complementary data signals Di0P and Di0R. First data processing unit 14-1 receives data signals Di0P and Di0R of first differential data signal Di0, and internal clock signal CLK', and generates output data d_1 and output data clock signal BCLK1. In particular, first de-skew circuit 12-1 receives data signals Di0P and Di0R, and internal clock signal CLK', and generates a de-skewed data signal Di0' and a de-skewed internal clock signal CLK". First de-skew circuit 12-1 provides de-skewed data signal Di0' and de-skewed internal clock signal CLK" to first de-serializer circuit 13-1. First de-serializer circuit 13-1 generates output data d_1 and output data clock signal BCLK1 from de-skewed data signal Di0' and de-skewed internal clock signal CLK". In accordance with an embodiment of the invention, source driver 10-*i* may provide output data d_1 and output data clock signal BCLK1 to a display panel 40 (see, e.g., FIG. 6).

Figure 10:
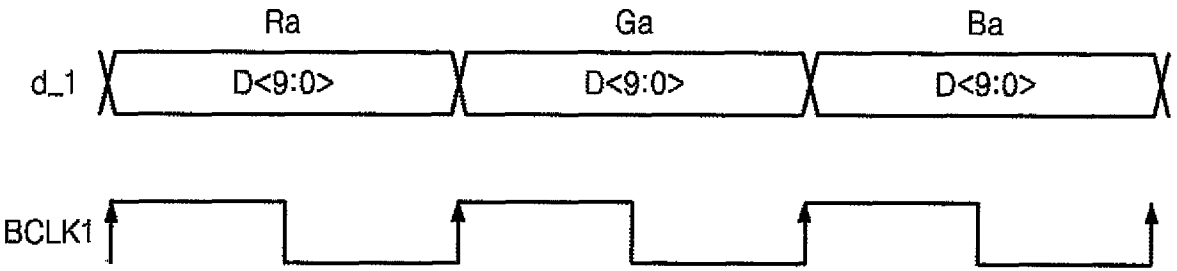
FIG. 10 is a timing diagram illustrating an output data signal and an output data clock signal in accordance with an embodiment of the invention.

Source driver 10-*i* may provide color information to display panel 40 as output data d_1. For example, as illustrated in FIG. 10, output data d_1 may take the form of multiple-bit data packets D<9:0> successively provided to display panel 40 over each cycle of output data clock signal BCLK1. That is, source driver 10-*i* may provide one data packet D<9:0> to display panel 40 as output data d_1 over each cycle of output data clock signal BCLK1. Each data packet D<9:0> may provide 10-bit depth color information to display panel 40, and display panel 40 may comprise a latch block that latches individual bits within a data packet D<9:0>. The data latch may provide the latched data as input data to external digital-to-analog converters (DACs). As illustrated in FIG. 10, source driver 10-*i* may successively provide to display panel 40 as output data d_1 a data packet Ra, which is data packet D<9:0> of red color information, a data packet Ga, which is data packet D<9:0> of green color information, and a data packet Ba, which is data packet D<9:0> of blue color information. Additionally, output data d_1 is not limited to 10-bit data packets D<9:0>. For example, output data d_1 may take the form of 8-bit data packets D<7:0> each providing 8-bit depth color information, or 12-bit data packets D<11:0> each providing 12-bit depth color information.

Similarly, as illustrated in FIG. 4, second differential data signal Di1 comprises complementary data signals Di1P and Di1R. Second data processing unit 14-2 receives data signals Di1P and Di1R of second differential data signal Di1, and internal clock signal CLK', and generates output data d_2 and output data clock signal BCLK2. In particular, second de-skew circuit 12-2 receives data signals Di1P and Di1R, and internal clock signal CLK', and generates a de-skewed data signal Di1' and a de-skewed internal clock signal CLK". Second de-skew circuit 12-2 provides de-skewed data signal Di1' and de-skewed internal clock signal CLK" to second de-serializer circuit 13-2. Second de-serializer circuit 13-2 generates output data d_2 and output data clock signal BCLK2 from de-skewed data signal Di1' and de-skewed internal clock signal CLK". In accordance with an embodiment of the invention, source driver 10-*i* may provide output data d_2 and output data clock signal BCLK2 to a display panel 40 (see, e.g., FIG. 6). The format of output data d_2 may be similar to the exemplary format of output data d_1 illustrated in FIG. 10 and described above. Additionally, output data d_2 may correspond to output data clock signal BCLK2 as output data d_1 corresponds to output data clock signal BCLK1 in the example illustrated in FIG. 10 and described above.

In accordance with an embodiment of the invention, clock regenerator 11 may generate a single-phase clock signal, which may be used as in a tracking clock and data recovery circuit (CDR), from shared differential clock signal CLK. Alternatively, in accordance with an embodiment of the invention, clock regenerator 11 may generate a plurality of multi-phase clocks used to operate data latches in source driver 10-*i* from shared differential clock signal CLK. In such an embodiment, certain latched data may be selected for further processing in source driver 10-*i*. Additionally, in accordance with an embodiment in which clock regenerator 11 generates several multi-phase clock signals, source driver data processing unit 14 of source driver 10-*i* may de-skew and de-serialize received data based on a selected one of the multi-phase clock signals.

Figure 11:
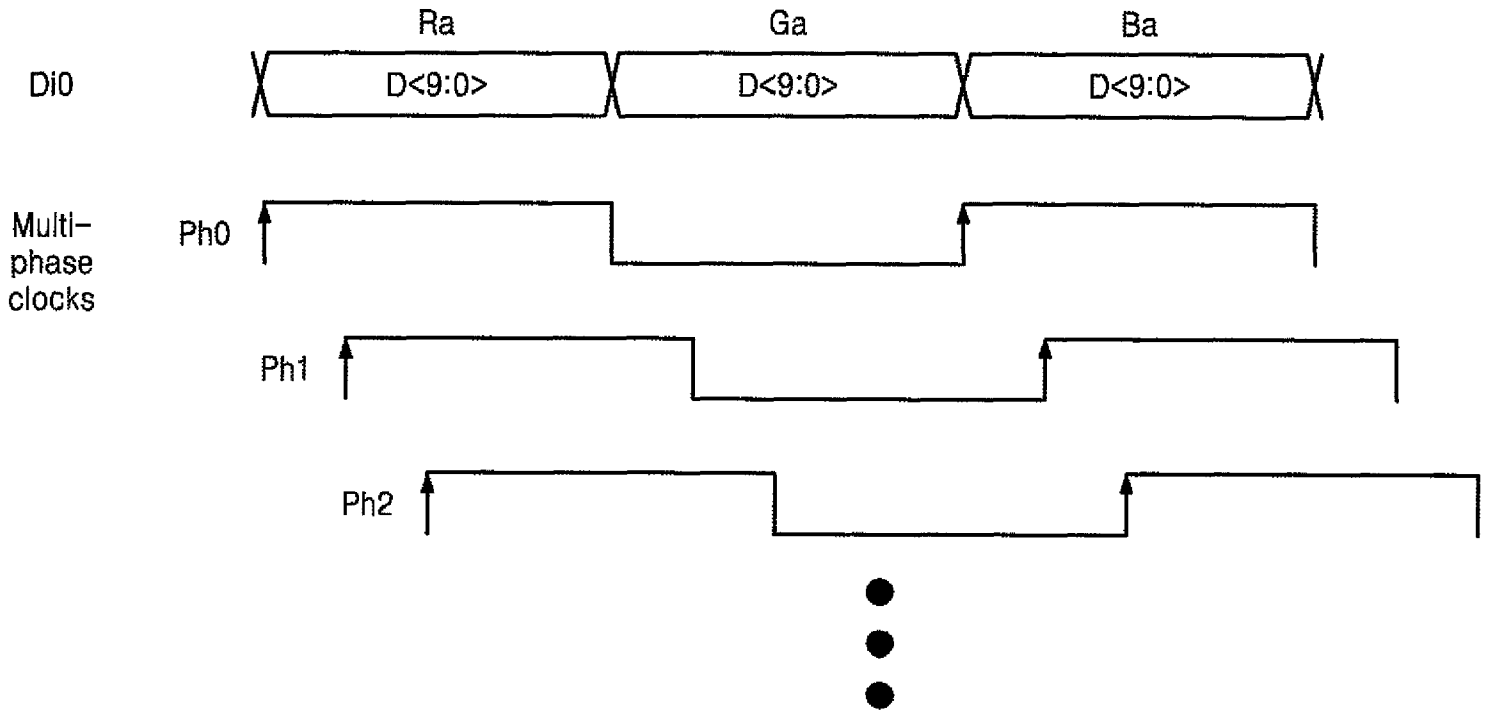
FIG. 11 is a timing diagram illustrating a differential data signal and multi-phase clocks in accordance with an embodiment of the invention.

The multi-phase clock signals may have different phases from one another and may be used for latching data input at a relatively high speed. For example, each of the multi-phase clock signals may be used to latch input data at half the data rate. As a consequence of latching the data in accordance with each of the multi-phase clock signals, the same data may be latched multiple times. Thus, certain latched data among all of the latched data may be selected for further processing in source driver 10-*i*. FIG. 11 shows an exemplary differential data signal Di0 and exemplary multi-phase clocks Ph0, Ph1, and Ph2. In the example illustrated in FIG. 11, multi-phase clocks Ph0, Ph1, and Ph2 have different phases from one another and cycle at half of the data rate relative to differential data signal Di0.

Figure 5:
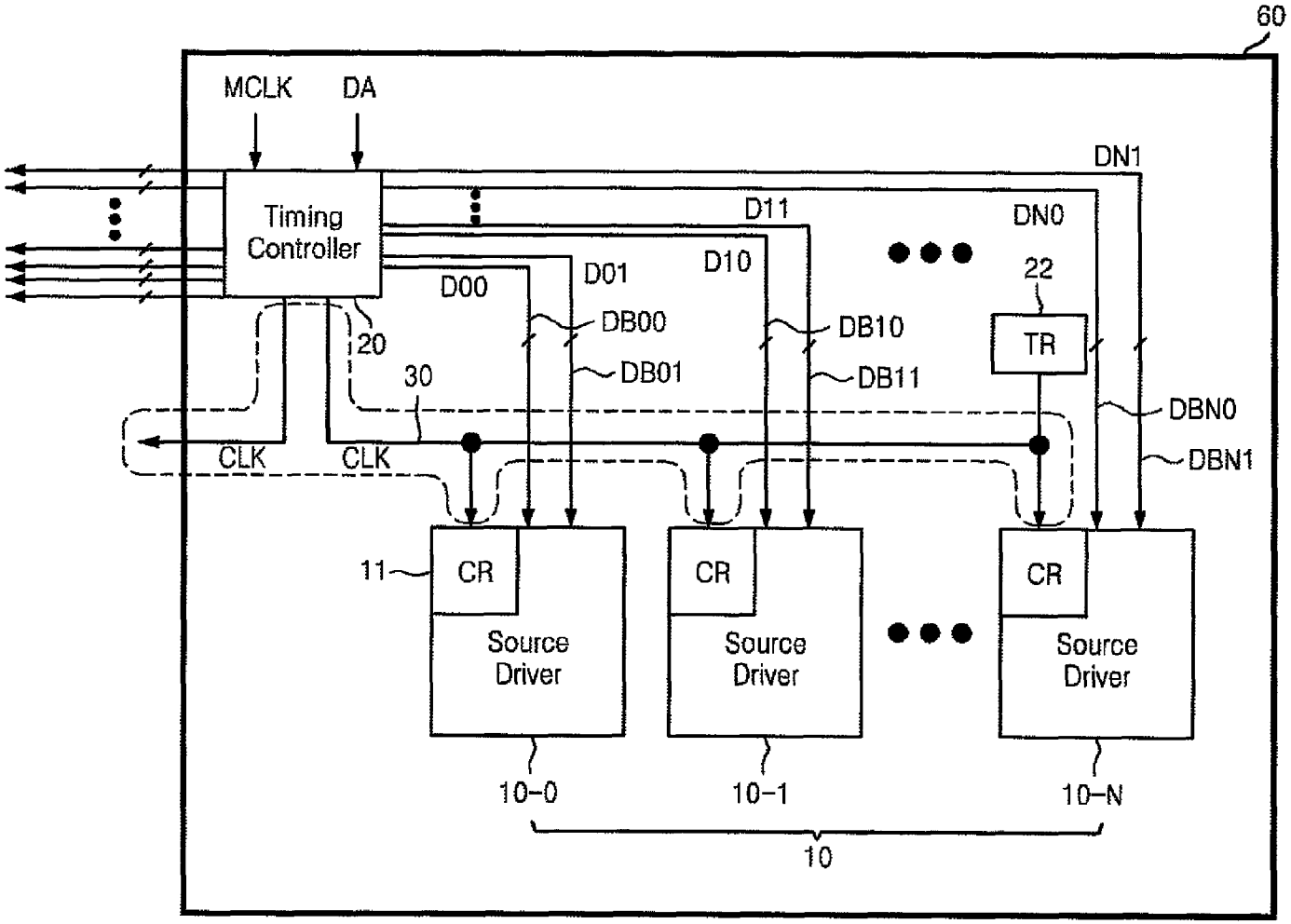
FIG. 5 illustrates a display driver integrated circuit module in accordance with an embodiment of the invention.

FIG. 5 illustrates a display driver integrated circuit (IC) module 60 in accordance with an embodiment of the invention. In the embodiment illustrated in FIG. 5, a display driver IC module 60 comprises clock-shared differential signaling interface 2. Display driver IC module 60 comprises timing controller 20 and source driver unit 10, which comprises source drivers 10-0 through 10-N. Additionally, timing controller 20 provides shared differential clock signal CLK to source drivers 10-0 through 10-N via a multi-drop connection provided by shared differential clock signal bus 30. Also in display driver IC module 60, timing controller 20 provides two differential data signals to each source driver 10-*i* among source drivers 10-0 through 10-N via respective point-to-point connections between timing controller 20 and source drivers 10-0 through 10-N. The respective point-to-point connections are provided by data buses DB00, DB01 through DBN0, DBN1. Additionally, timing controller 20 may provide more than two differential data signals to each source driver 10-*i* via more than two point-to-point connections between timing controller 20 and source driver 10-*i*. The additional point-to-point connections may be provided by additional data buses. In addition, timing controller 20 receives master clock signal MCLK and input data DA from outside of display driver IC module 60.

Figure 6:
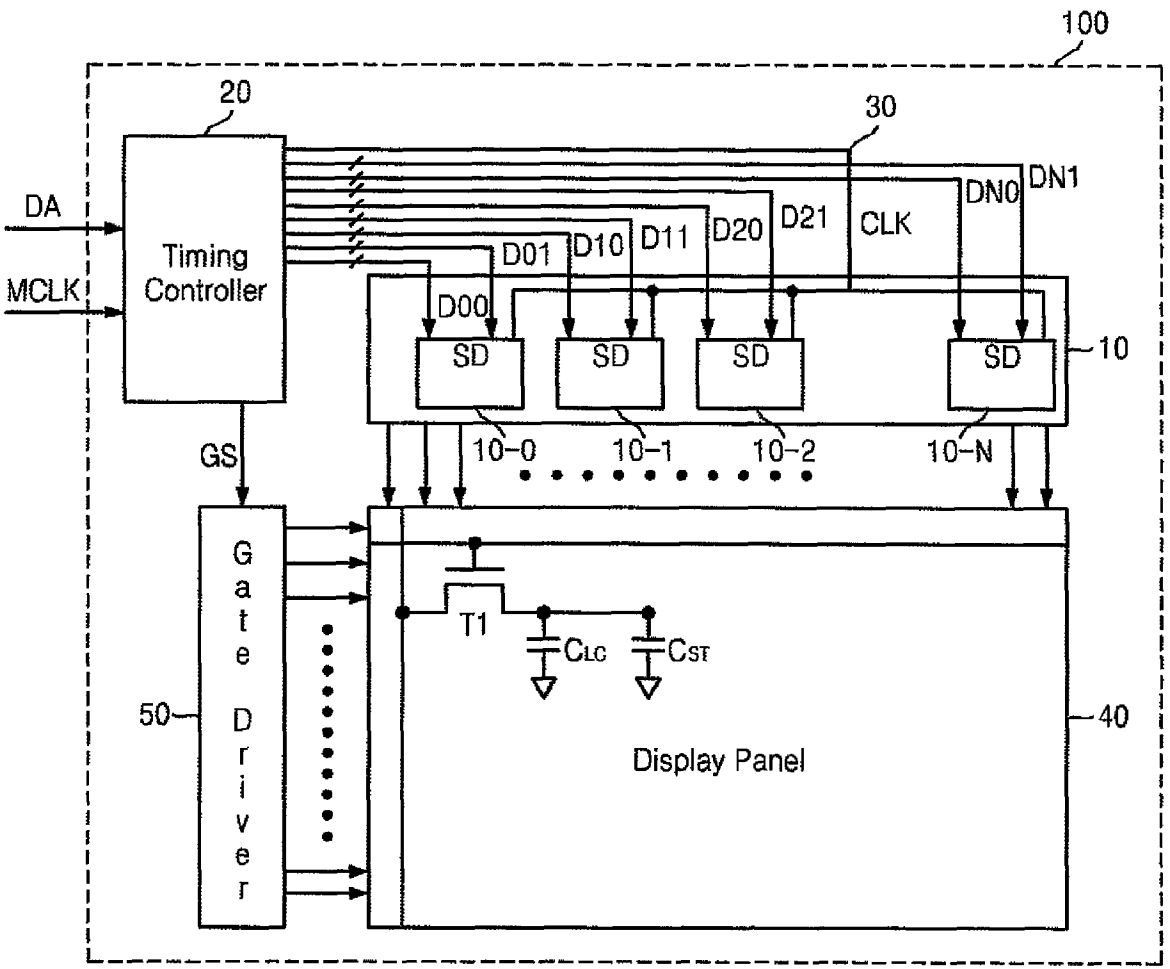
FIG. 6 illustrates a display apparatus in accordance with an embodiment of the invention.

FIG. 6 illustrates a display apparatus 100 (which may also be referred to herein as a display system 100) in accordance with an embodiment of the invention. Display apparatus 100 comprises timing controller 20, source driver unit 10, a gate driver 50, and a display panel 40. Source driver unit 10 comprises source drivers (SDs) 10-0 through 10-N. In addition, display apparatus 100 comprises a clock-shared differential signaling interface similar to the clock-shared differential signaling interface illustrated in FIG. 2. In particular, in the embodiment illustrated in FIG. 6, timing controller 20 provides a shared differential clock signal CLK to each of source drivers 10-0 through 10-N via a multi-drop connection provided by shared differential clock signal bus 30. In addition, timing controller 20 provides differential data signals to source drivers 10-0 through 10-N via point-to-point connections provided by data buses DB00, DB01 through DBN0, DBN1 (see, e.g., FIG. 2). In the embodiment illustrated in FIG. 6, timing controller 20 provides two differential data signals Di0 and Di1 to each source driver 10-*i* via two data buses DBi0, DBi1 connected point-to-point between timing controller 20 and source driver 10-*i*. Additionally, timing controller 20 may provide more than two differential data signals to each source driver 10-*i* via more than two point-to-point connections between timing controller 20 and source driver 10-*i*. The additional point-to-point connections may be provided by additional data buses.

Source driver unit 10 may also provide various output signals to display panel 40. In particular, in accordance with an embodiment of the invention, source drivers 10-0 through 10-N may provide data and clock signals to display panel 40. For example, as illustrated in FIG. 4, source driver 10-*i* outputs output data d_1 and d_2, and outputs output data clock signals BCLK1 and BCLK2. Each of source drivers 10-0 through 10-N may provide analogous output data and clock signals to display panel 40, and source driver unit 10 may thereby provide data and clock signals to display panel 40.

In addition, gate driver 50 receives gate signals GS from timing controller 20 and provides various output signals to display panel 40. Gate signals GS provided from timing controller 20 to gate driver 50 are gate switching signals that periodically turn ON and OFF gate drivers within gate driver 50.

Figure 7:
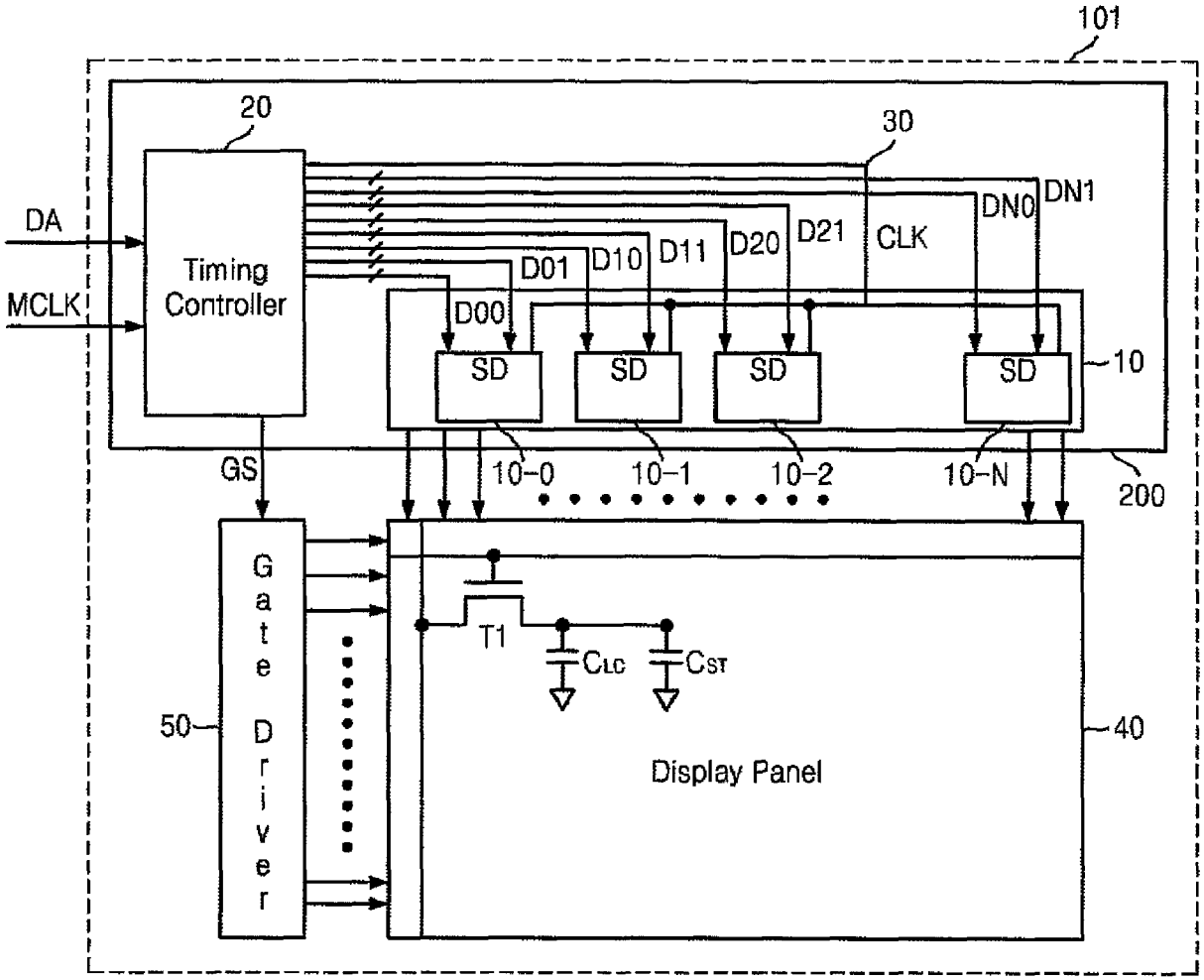
FIG. 7 illustrates a display apparatus in accordance with another embodiment of the invention.
Figure 8:
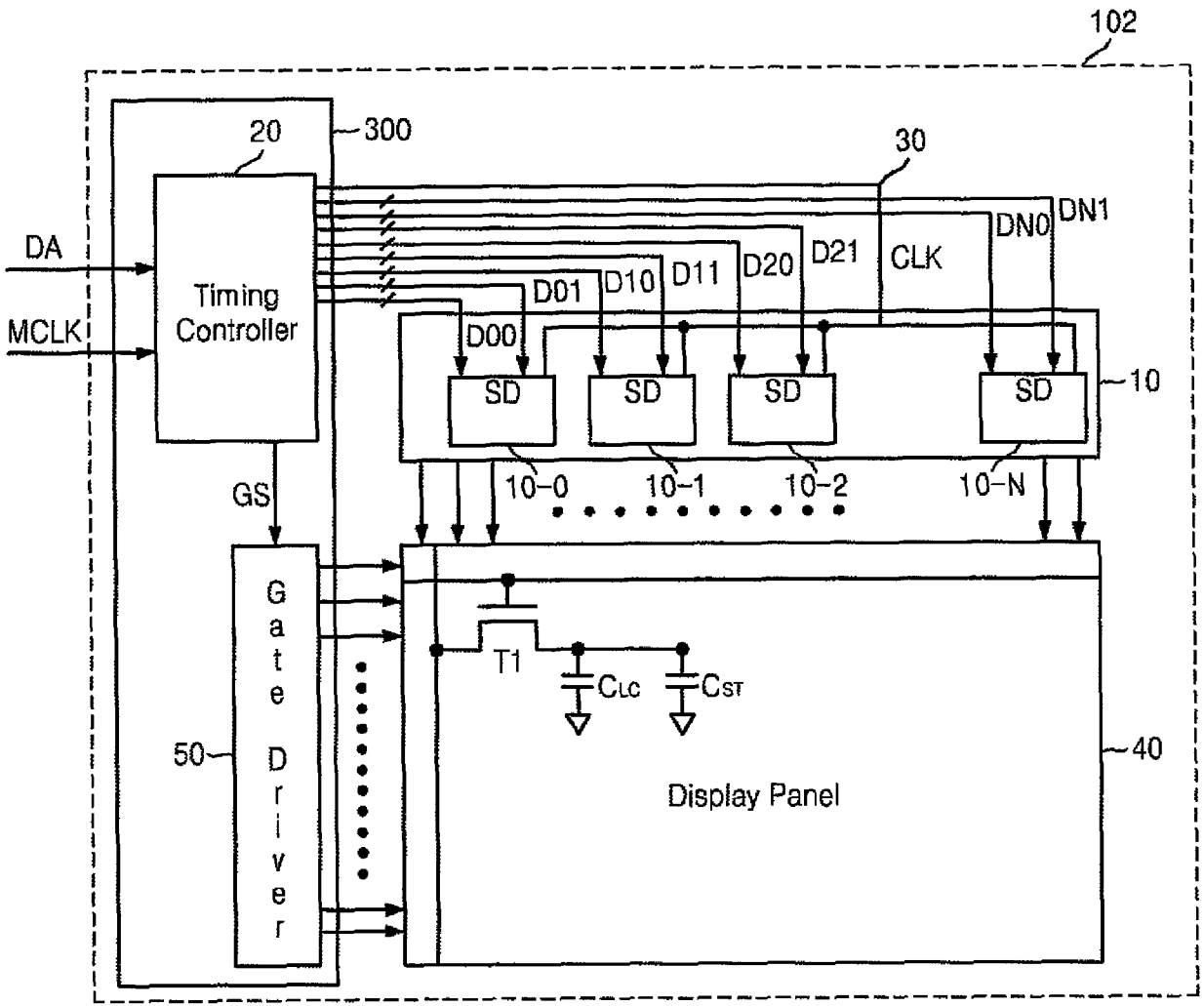
FIG. 8 illustrates display apparatus in accordance with yet another embodiment of the invention.

In the embodiments illustrated in FIGS. 6-8, display panel 40 is an LCD display panel. However, display panel 40 may alternatively be, for example, a PDP display panel, an OLED display panel, a flexible display panel, etc. Display panel 40 comprises a multiplicity of display circuits comprising (e.g.) a transistor T1, a capacitor $C_{LC}$, and a capacitor $C_{ST}$. Each of capacitors $C_{LC}$ and $C_{ST}$ is connected between one terminal of transistor T1 and ground. Although FIG. 6 shows only one display circuit in display panel 40, display panel 40 may comprise a plurality of display circuits.

FIG. 7 illustrates a display apparatus 101 in accordance with another embodiment of the invention. As illustrated in FIG. 7, display apparatus 101 may comprise a source driver chip 200, wherein timing controller 20, source driver unit 10 (comprising source drivers (SDs) 10-0 through 10-N), and buses connecting timing controller 20 and source driver unit 10 are disposed on source driver chip 200 (i.e., on a single chip). In addition, display apparatus 101, including source driver chip 200, may be disposed in a single chip package. Display panel 40, gate driver 50, and their respective configurations within display apparatus 101 are similar to display panel 40, gate driver 50, and their respective configurations within display apparatus 100 of FIG. 6. Thus, further description thereof will be omitted here.

FIG. 8 illustrates display apparatus 102 in accordance with yet another embodiment of the invention. As illustrated in FIG. 8, display apparatus 102 may comprise a gate driver chip 300, wherein timing controller 20 and gate driver 50 are disposed on gate driver chip 300 (i.e., on a single chip). However, source driver unit 10 (comprising source drivers (SDs) 10-0 through 10-N) is not disposed on gate driver chip 300. In addition, display apparatus 102, including gate driver chip 300, may be disposed in a single chip package. Display panel 40, source driver unit 10, and their respective configurations within display apparatus 102 are similar to display panel 40, source driver unit 10, and their respective configurations within display apparatus 100. Thus, further description thereof will be omitted here.

Figure 9:
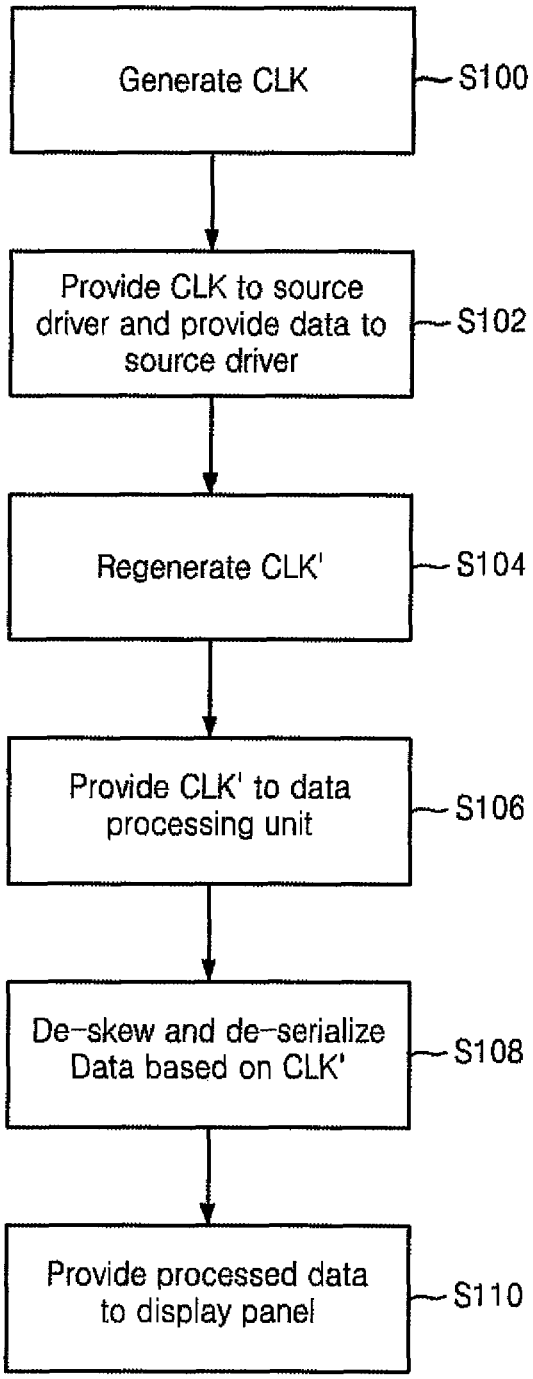
FIG. 9 is a flowchart summarizing a method of driving output data to a display panel in accordance with an embodiment of the invention.

FIG. 9 is a flowchart summarizing a method of driving output data to a display panel in accordance with an embodiment of the invention. The method summarized in FIG. 9 will be described with reference to FIGS. 2, 3, 4, and 6.

Referring to FIGS. 2, 3, and 9, timing controller 20 generates a shared differential clock signal CLK from master clock signal MCLK, wherein MCLK has a higher frequency than shared differential clock signal CLK (S100). In accordance with the embodiment illustrated in FIG. 3, clock generator 21 of timing controller 20 generates shared differential clock signal CLK from master clock signal MCLK. Then, timing controller 20 provides shared differential clock signal CLK to source drivers 10-0 through 10-N via a multi-drop connection, and provides differential data signals to source drivers 10-0 through 10-N via point-to-point connections (S102). In the embodiment illustrated in FIG. 2, shared differential clock signal bus 30 provides the multi-drop connection, and data buses DB00, DB01 through DBN0, DBN1 provide the point-to-point connections. Each of source drivers 10-0 through 10-N then regenerates internal clock signal CLK' from shared differential clock signal CLK (S104). Internal clock signal CLK' has a higher frequency than shared differential clock signal CLK, but the frequency of internal clock signal CLK' is not necessarily the same as the frequency of master clock signal MCLK. In accordance with the embodiment illustrated in FIG. 4, the clock regenerator 11 of each source driver 10-*i* among source drivers 10-0 through 10-N regenerates internal clock signal CLK' from shared differential clock signal CLK. In accordance with an embodiment of the invention, internal clock signal CLK' may be a single-phase clock signal. Alternatively, in accordance with an embodiment of the invention, clock regenerator 11 may generate a plurality of multi-phase clock signals from shared differential clock signal CLK rather than internal clock signal CLK'.

Then, referring to FIG. 4, clock regenerator 11 of each source driver 10-*i* provides internal clock signal CLK' to data processing unit 14 of source driver 10-*i* (S106). Alternatively, in accordance with an embodiment of the invention, clock regenerator 11 of each source driver 10-*i* may provide a selected clock signal among the plurality of multi-phase clock signals to data processing unit 14 of source driver 10-*i*. Subsequently, the data processing unit 14 of each source driver 10-*i* de-skews and de-serializes received differential data signals in accordance with internal clock signal CLK' (S108). Alternatively, in accordance with an embodiment of the invention, each source driver 10-*i* may de-skew and de-serialize received differential signals Di0 and Di1 in accordance with the selected clock signal among the plurality of multi-phase clock signals received from clock regenerator 11 of source driver 10-*i*. Each source driver 10-*i* then provides the processed data to a display panel (S110). For example, in the embodiment illustrated in FIG. 4, each source driver 10-*i* provides output data d_1 and d_2, along with output data clock signals BCLK1 and BCLK2, to display panel 40 (see FIG. 6).

The method described above in accordance with an embodiment of the invention may provide an increased data rate for an interface using two-level signaling and the provision of a clock signal separate from differential data signals. Thus, the method described above may avoid the disadvantages of using multi-level signaling and embedded-clock signaling. Additionally, by providing a clock signal having a relatively low frequency to the source drivers, the signal integrity of the clock signal provided to the source drivers via shared differential clock signal bus 30 may be enhanced. Also, the adverse effects of electro-magnetic interference (EMI) on the clock signal may be reduced by providing a clock signal having a relatively low frequency to the source drivers.

Embodiments of the invention provide a clock-shared differential signaling interface and a method of driving output data to a display panel. In the clock-shared differential signaling interface, a timing controller provides differential data signals to source drivers via point-to-point connections, and provides a shared differential clock signal to source drivers via a multi-drop connection. A clock-shared differential signaling interface in accordance with an embodiment of the invention may provide an increased rate of data transfer between the timing controller and the source drivers without using multi-level signaling or embedded-clock signaling. Thus, a clock-shared differential signaling interface in accordance with an embodiment of the invention may provide an increased data rate without the disadvantages of using multi-level signaling or embedded-clock signaling. Additionally, in a clock-shared differential signaling interface in accordance with an embodiment of the invention, a timing controller may provide a clock signal having a relatively low frequency to the source drivers. Thus, a clock-shared differential signaling interface in accordance with an embodiment of the invention may enhance the signal integrity of the clock signal provided to the source drivers and reduce the adverse effects of electromagnetic interference (EMI) on the clock signal.

Although embodiments of the invention have been described herein, modifications may be made to those embodiments without departing from the scope of the invention, as defined by the accompanying claims.

What is claimed is:

1. A display driver integrated circuit comprising:

a plurality of driver circuits, wherein each driver circuit in the plurality of driver circuits respectively provides output data;

a clock bus having a multi-drop connection to the plurality of driver circuits;

a resistive termination circuit coupled to the clock bus; and a timing controller providing a first clock signal to the plurality of driver circuits via the multi-drop connection of the clock bus, and providing a respective differential data signal to each driver circuit via a respective point-to-point connection, wherein each driver circuit comprises a clock regenerator receiving the first clock signal and generating a third clock signal, and wherein each driver circuit comprises:

a de-skew circuit receiving the respective differential data signal and the third clock signal and generating a de-skewed data signal and a fourth clock signal; and a de-serializer circuit receiving the de-skewed data signal and the fourth clock signal and generating the output data and a corresponding fifth clock signal.

2. The display driver integrated circuit of claim 1, wherein the first clock signal is derived in the timing controller from a received second clock signal, and wherein the first clock signal is a shared differential clock signal.

3. The display driver integrated circuit of claim 2, wherein a frequency of the second clock signal is higher than a frequency of the first clock signal.

4. The display driver integrated circuit of claim 3, wherein the timing controller comprises a clock generator circuit receiving the second clock signal and generating the first clock signal from the second clock signal.

5. The display driver integrated circuit of claim 4, wherein the clock generator circuit comprises:

a phase-lock-loop (PLL) circuit receiving the second clock signal and generating a third clock signal; and a clock divider receiving and dividing down the third clock signal to generate the first clock signal.

6. The display driver integrated circuit of claim 1, wherein a frequency of the third clock signal is higher than the frequency of the first clock signal.

7. The display driver integrated circuit of claim 1, wherein the timing controller and the plurality of driver circuits are commonly integrated within a single integrated circuit chip.

8. The display driver integrated circuit of claim 7, wherein the first clock signal is derived in the timing controller from a second clock signal.

9. The display driver integrated circuit of claim 8, wherein a frequency of the second clock signal is higher than a frequency of the first clock signal.

10. The display driver integrated circuit of claim 9, wherein the timing controller comprises a clock generator circuit receiving the second clock signal and generating the first clock signal from the second clock signal, and wherein the first clock signal is a shared differential clock signal.

11. The display driver integrated circuit of claim 1, wherein each of the respective point-to-point connections comprises a data bus connected between the timing controller and only one of the plurality of driver circuits.

12. The display driver integrated circuit of claim 1, wherein each driver circuit is a source driver circuit.

13. A display apparatus comprising:

a display panel;

a plurality of driver circuits respectively providing output data to the display panel;

a clock bus having a multi-drop connection to the plurality of driver circuits;

a resistive termination circuit coupled to the clock bus; and a timing controller providing a first clock signal to the plurality of driver circuits via the multi-drop connection of the clock bus, and providing a respective differential data signal to each driver circuit via a respective point-to-point connection, wherein each driver circuit comprises a clock regenerator receiving the first clock signal and generating a third clock signal, and wherein each driver circuit comprises:

a de-skew circuit receiving the respective differential data signal and the third clock signal and generating a de-skewed data signal and a fourth clock signal; and a de-serializer circuit receiving the de-skewed data signal and the fourth clock signal and generating the output data and a corresponding fifth clock signal.

14. The display apparatus of claim 13, wherein the first clock signal is derived in the timing controller from a received second clock signal.

15. The display apparatus of claim 14, wherein a frequency of the second clock signal is higher than a frequency of the first clock signal.

16. The display apparatus of claim 15, wherein the timing controller comprises a clock generator circuit receiving the second clock signal and generating the first clock signal from the second clock signal, and wherein the first clock signal is a shared differential clock signal.

17. The display apparatus of claim 13, further comprising:

a gate driver receiving a gate signal from the timing controller and providing output signals to the display panel, wherein the timing controller and the source driver unit are commonly integrated within a single integrated circuit chip.

18. The display apparatus of claim 17, wherein the source driver unit, the gate driver, the timing controller, and the display panel are disposed in a single chip package.

19. The display apparatus of claim 13, further comprising:

a gate driver receiving a gate signal from the timing controller and providing output signals to the display panel, wherein the timing controller and the gate driver are commonly integrated within a single integrated circuit chip.

20. The display apparatus of claim 19, wherein the source driver unit, the gate driver, the timing controller, and the display panel are disposed in a single chip package.

21. A method of driving output data to a display panel, the method comprising:

generating a first clock signal from a second clock signal;

providing the first clock signal to a clock bus having a multi-drop, wherein a resistive termination circuit is coupled to the clock bus;

providing the first clock signal to each driver circuit of a plurality of driver circuits via the multi-drop connection of the clock bus;

providing differential data signals to the driver circuits, respectively, via respective point-to-point connections;

regenerating a third clock signal from the first clock signal at each of the driver circuits;

generating a portion of the output data at each of the driver circuits in relation to the third clock signal and the received differential data signal; and providing the output data to the display panel, wherein generating a portion of the output data at each of the driver circuits in relation to the internal clock signal and the received differential data signal comprises, for each of the driver circuits:

generating a de-skewed data signal and a fourth clock signal in relation to the received differential data signal and the third clock signal; and generating the portion of the output data and a corresponding fifth clock signal in relation to the de-skewed data signal and the fourth clock signal using a de-serializer circuit.

22. The method of claim 21, wherein a frequency of the second clock signal is higher than a frequency of the first clock signal; and wherein a frequency of the third clock signal is higher than the frequency of the first clock signal.

23. The method of claim 22, wherein generating the first clock signal from the second clock signal comprises:

providing the second clock signal to a timing controller;

generating a fourth clock signal from the second clock signal; and generating the first clock signal from the fourth clock signal.

24. The method of claim 23, further comprising:

providing input data to the timing controller; and wherein providing differential data signals to each of the driver circuits, respectively, via respective point-to-point connections comprises:

generating the differential data signals from the input data in relation to the second clock signal; and providing the differential data signals to the driver circuits, respectively, via a plurality of data buses, wherein each of the data buses is connected to the timing controller and only one of the driver circuits.

25. The method of claim 22, wherein regenerating the third clock signal from the first clock signal at each of the driver circuits comprises, for each of the driver circuits, providing the first clock signal to a clock regenerator of the driver circuit.

26. The method of claim 21, further comprising:

for each of the driver circuits, providing the fifth clock signal to the display panel.

* * * * *